US005878966A

United States Patent [19]

Asakawa et al.

[11] Patent Number: 5,878,966

[45] Date of Patent: Mar. 9, 1999

[54] DESCALING NOZZLE

[75] Inventors: Hiroyoshi Asakawa, Nishinomiya; Toshie Hashimoto, Hyogo-ken, both of Japan

[73] Assignee: Kyoritsu Gokin Mfg. Co., Ltd., Japan

[21] Appl. No.: 836,861

[22] PCT Filed: Oct. 2, 1996

[86] PCT No.: PCT/JP96/02886

§ 371 Date: May 21, 1997

§ 102(e) Date: May 21, 1997

[87] PCT Pub. No.: WO97/12684

PCT Pub. Date: Apr. 10, 1997

[30] Foreign Application Priority Data

Oct. 3, 1995 [JP] Japan ..... 7-256002

[51] Int. Cl.[6] ..... B05B 1/00

[52] U.S. Cl. ..... 239/590; 239/589; 239/590.3; 239/597; 239/599

[58] Field of Search ..... 239/589, 590, 239/590.3, 590.5, 597, 599

[56] References Cited

U.S. PATENT DOCUMENTS

| | | | |
|---|---|---|---|
| 1,192,901 | 8/1916 | Irish | 239/589 |
| 2,701,412 | 2/1955 | Wahlin | 239/599 |
| 2,794,683 | 6/1957 | Michaels | 239/597 X |
| 3,776,706 | 12/1973 | Daniels et al. | 29/182.5 |
| 4,063,908 | 12/1977 | Ogawa et al. | 51/307 |
| 4,097,000 | 6/1978 | Derr | 239/599 |
| 4,848,672 | 7/1989 | Matsumoto et al. | 239/590.5 |
| 5,597,122 | 1/1997 | Eisenmann | 239/589 |
| 5,673,858 | 10/1997 | Asakawa et al. | 239/590.3 X |

FOREIGN PATENT DOCUMENTS

| | | | |
|---|---|---|---|
| 334586 | of 1903 | France | 239/592 |
| 41312 | 12/1932 | France | 239/592 |
| 63-107747 | 7/1988 | Japan . | |
| 1111464 | 4/1989 | Japan . | |
| 4348873 | 12/1992 | Japan . | |

*Primary Examiner*—Andres Kashnikow
*Assistant Examiner*—Robin O. Evans
*Attorney, Agent, or Firm*—Webb Ziesenheim Bruening Logsdon Orkin & Hanson, P.C.

[57] ABSTRACT

The present invention relates to a descaling nozzle for removing scales from a metal surface by causing a high-pressure liquid to collide with the metal surface. In the descaling nozzle, the nozzle body includes a concave section formed at a forward end thereof with respect to a liquid jetting direction and having a diameter reducing as it extends downstream with respect to the liquid jetting direction. The forward end has an annular shape integrally surrounding an entire outer circumference of said concave section. The orifice has an outlet opening at a bottom of said concave section around an entire circumference thereof. Thus, the orifice peripheries have high wear resistance against ultrahigh-pressure water and have durability, and can be effectively prevented from damage.

14 Claims, 7 Drawing Sheets

DESCALING NOZZLE

TECHNICAL FIELD

The present invention relates to descaling nozzles, and particularly to a descaling nozzle having a nozzle body formed of cemented carbide and defining a liquid passage having a diameter reducing as it extends downstream with respect to a liquid jetting direction, and an orifice in the form of a slot when seen in the liquid jetting direction and having an inlet communicating with a downstream position with respect to the liquid jetting direction of the liquid passage, for causing a high-pressure liquid jetting from the orifice to collide with a metal surface to remove scales from the metal surface.

BACKGROUND ART

In order to enhance descaling performance, there has been a demand in recent years for the above-mentioned descaling nozzle to jet ultrahigh-pressure water with a pressure of about 30 to 100 MPa. However, the higher pressure of such ultrahigh-pressure water wears orifice peripheries of the nozzle body at the greater rate through contact with the orifice peripheries. In order to meet the demand, it is necessary to minimize the wear of the orifice peripheries, thereby to increase durability.

When the jetting high-pressure water is collected for repeated use, the high-pressure water contains fine scales and the like. The fine scales and the like further accelerate the wear.

Under the circumstances, it has been considered to increase the hardness of the cemented carbide forming the nozzle body, thereby to improve wear resistance of orifice peripheries. For example, the nozzle body may be formed of a carbide hard metal containing tungsten (W) as its main component. However, it is known that, with increased hardness, tenacity and impact resistance are impaired to become susceptible to chipping (Japanese Laid-open Patent Application No. 4-348873).

In a conventional descaling nozzle, as shown in FIGS. 12–14, a nozzle tip 01 acting as a nozzle body includes a groove 03 of U-shaped cross section formed in a distal end thereof and crossing a high-pressure water discharge passage 02 in a downstream position with respect to a high-pressure water jetting direction. An elongated (when seen in the high-pressure water jetting direction) orifice 04 is formed at the intersection of the high-pressure water discharge passage 02 and the groove 03. Orifice peripheries 05 define thin wall portions 06 in the form of knife edges in bottoms of the groove 03 and at longitudinal positions of the orifice (Japanese Laid-open Patent Application No. 1-111464).

When ultrahigh-pressure water is jetted with a higher pressure than before, the thin wall portions 06 tend to be worn away or chipped as indicated by dot-and-dash lines in FIG. 13. The orifice peripheries 05 are damaged quickly, resulting in a deformation of the orifice 04 and a reduction in the jetting pressure of the ultrahigh-pressure water to become unable to remove scales efficiently. Thus, there is a drawback that the durability of the orifice peripheries 05 cannot be improved. Particularly where ultrahigh-pressure water containing fine scales is jetted, there occurs a drawback that the thin wall portions 06 are more susceptible to chipping due to the fine scales colliding with the thin wall portions 06.

When descaling rolled metal, a plurality of descaling nozzles are often juxtaposed for use. Ultrahigh-pressure water jetting from one descaling nozzle may splash in the longitudinal direction of the groove 03 of another descaling nozzle and collide with the thin wall portions 06 of that nozzle tip 01. This may also result in early damage of the orifice peripheries 05.

The present invention has been devised to solve these drawbacks of the prior art, and its object is to provide a descaling nozzle which includes orifice peripheries of improved configuration whereby the orifice peripheries have increased wear resistance against ultrahigh-pressure water, and which effectively prevents the orifice peripheries from being damaged due to a decrease in the impact resistance resulting from the increased wear resistance.

DISCLOSURE OF THE INVENTION

The above object is fulfilled by the claimed invention.

The characteristic construction of a descaling nozzle according to the present invention is as follows:

A nozzle body formed of cemented carbide defines;

a liquid passage having a diameter reducing as it extends downstream with respect to a liquid jetting direction; and an orifice having an inlet communicating with an end of said liquid passage downstream with respect to the liquid jetting direction and elongated when seen in the liquid jetting direction;

said orifice jetting out a high-pressure liquid against a metal surface to remove scales from the metal surface;

said nozzle body including a concave section formed at a forward end thereof with respect to the liquid jetting direction and having a diameter reducing as it extends upstream with respect to the liquid jetting direction, said forward end having an annular shape integrally surrounding an entire outer circumference of said concave section; and said orifice having an outlet opening at a bottom of said concave section through an entire circumference thereof.

In this construction, the concave section and an inner surface of the liquid passage may form a large angle across orifice peripheries through the entire circumference of the orifice. The orifice peripheries may be thick-walled in the liquid jetting direction through the entire circumference of the orifice. Furthermore, the outlet of the orifice is entirely surrounded by the annular forward end protruding in the liquid jetting direction. There is little possibility of high-pressure water jetting from a different descaling nozzle splashing back and colliding with the outlet of the orifice. In addition, the forward end having an annular shape integrally surrounding the entire outer circumference of the concave section, provides a reinforced structure to cope with severe conditions, compared with a forward end formed by a separate element.

Consequently, the hardness of the cemented carbide forming the nozzle body may be increased to enhance wear resistance of the orifice peripheries against ultrahigh-pressure water, and at the same time the orifice peripheries may be prevented from being damaged soon due to a decrease in the impact resistance resulting from the increased hardness of the cemented carbide.

Specifically, a construction as shown in FIGS. 4 and 6 can be realized.

In the descaling nozzle of the present invention, it is preferable that said cemented carbide has a Rockwell hardness (HRA) of 94.0 or higher by A Graduation of Rockwell hardness test stipulated in the Japanese Industrial Standards.

This construction can prevent, with greater effect, the orifice peripheries from being damaged soon, to realize a descaling nozzle having increased durability.

Nozzle bodies shaped according to the present invention were manufactured by using cemented carbide A, B, and C whose Rockwell hardness (HRA) was 88.7, 90.7, and 94.0, respectively. Each of these nozzle bodies was attached to a descaling nozzle. Each descaling nozzle was used to jet high-pressure water with a pumping pressure of 15.7 MPa for a fixed time period (about five weeks) under the same conditions, and a flow increase rate accompanying damage to the orifice peripheries was measured. As shown in FIG. 9, the descaling nozzles employing the nozzle bodies formed of cemented carbide A and B had very high flow increase rates. By contrast, the descaling nozzle with the nozzle body formed of cemented carbide C had a minimal increase rate. In addition, the flow increase rate became the lower with an increase in the Rockwell hardness (HRA) over 94.0. Thus, the orifice peripheries are prevented from being damaged with greater effect by using cemented carbide having a Rockwell hardness (HRA) of 94.0 or higher.

It is preferable that the concave section of the descaling nozzle of the present invention is formed to be out of contact with the high-pressure liquid jetting from said orifice.

With this construction, the concave section is hardly worn away or chipped. A jet pattern of the high-pressure water does not change with the shape of the concave section. Consequently, the jet pattern may be maintained in a predetermined pattern without difficulty.

It is preferable that an inner surface is formed through an inner circumference of said orifice to extend parallel to an orifice axis and between an inlet and an outlet of said orifice.

In this construction, as shown in FIGS. 4 and 6, the orifice peripheries 13 can be further thick-walled in the liquid jetting direction. In addition, as shown in FIG. 5, an inlet-side comer 15 and an outlet-side comer 16 of the orifice peripheries 13 may define obtuse angles, to reinforce the orifice peripheries 13 to prevent early damage thereof with increased effect.

BEST MODE FOR CARRYING OUT THE INVENTION

FIRST EMBODIMENT

Figure 1:
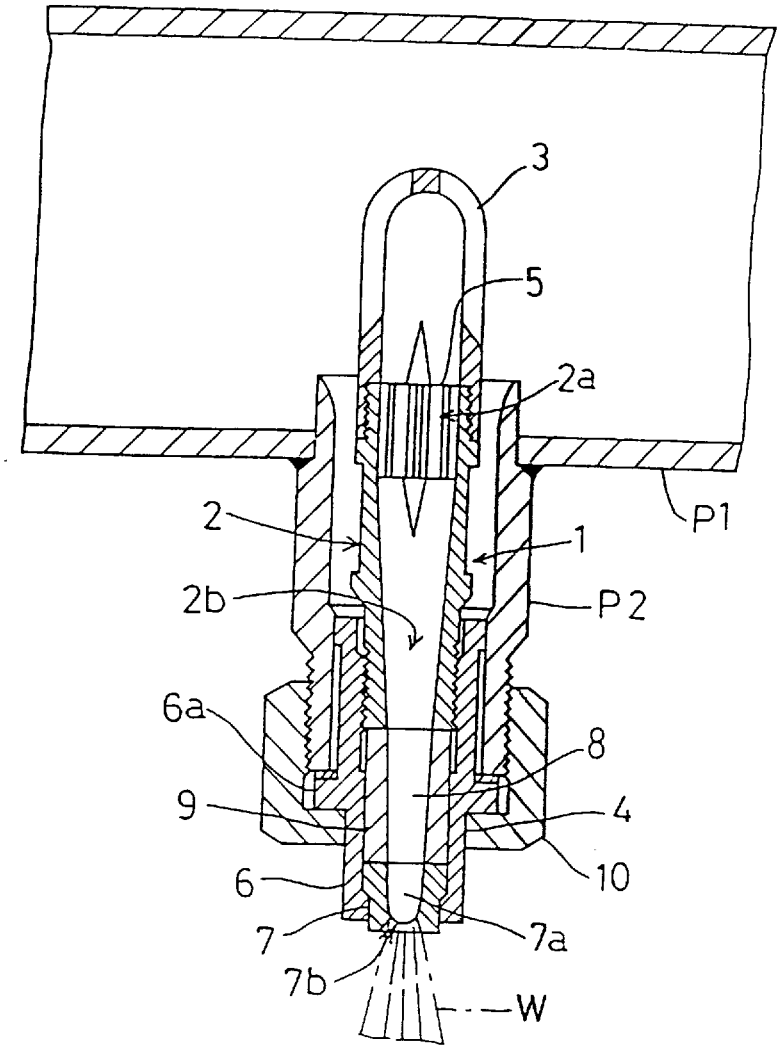
FIG. 1 is a sectional view of a descaling nozzle device.
Figure 4:
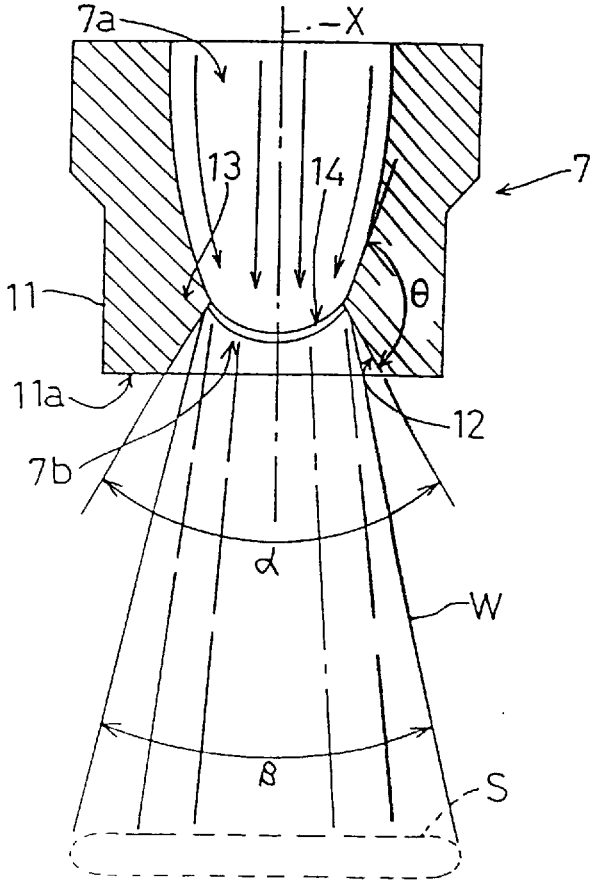
FIG. 4 is a section taken on line IV—IV of FIG. 3.

FIG. 1 shows a descaling device in this embodiment. This descaling device has a descaling nozzle 1 fixed to an adapter P2 for removing scales from a steel plate surface. As shown in FIG. 4, the descaling device removes scales from a surface of rolled steel plate by jetting high-pressure water W as high-pressure liquid with a pumping pressure of 15 to 60 Mpa, in a thin band spray pattern S to the surface of steel plate. The descaling nozzle 1 includes a cylindrical passage forming member 2, a filter 3 screwed to one end of the passage forming member 2, and a jet passage forming member 4 screwed to the other end of the passage forming member 2.

The passage forming member 2 has, formed coaxially with each other, a straightening passage 2*a* with a straightening device 5 mounted therein, and a restricting passage 2*b* continuous with a downstream end of the straightening passage 2*a*. The jet passage forming member 4 has a nozzle tip 7 coaxially press-fit in a nozzle case 6 to act as a nozzle body formed of carbide hard metal containing tungsten as a main component thereof. A bush 9 is mounted between the nozzle tip 7 and the passage forming member 2, and a jet passage 8 is formed downstream of the restricting passage 2*b* to continuous and coaxial therewith.

The adapter P2 is attached to a main pipe P1 in the form of a branch pipe. The descaling nozzle 1 is inserted into the adapter P2 with the filter 3 protruding into the main pipe P1. A packing is disposed between a flange 6*a* of the nozzle case 6 and an end of the adapter P2, and the nozzle case 6 is fixed tight to the adapter P2 with a cap nut 10. Thus, the descaling nozzle 1 is fixed to the main pipe P1.

Figure 2:
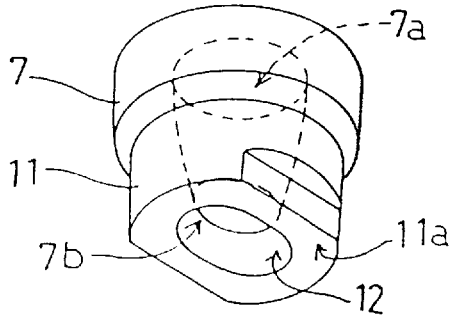
FIG. 2 is a perspective view of a nozzle tip.
Figure 3:
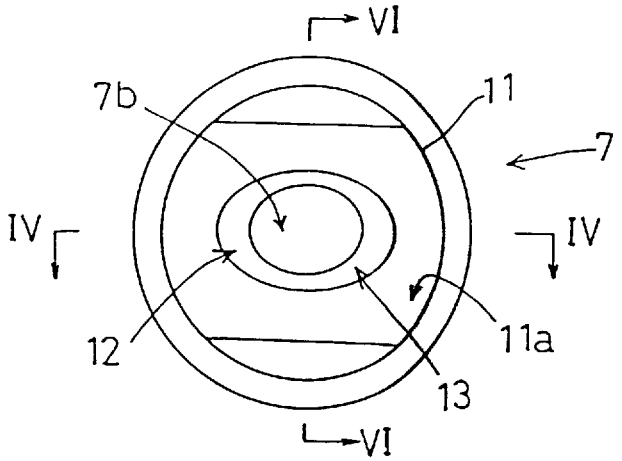
FIG. 3 is a front view of the nozzle tip.

The nozzle tip 7 is formed of cemented carbide whose Rockwell hardness in A Graduation of Rockwell hardness test (HRA) stipulated by JIS Standard (Japanese Industrial Standard) is about 94.0. As shown in FIG. 2, the nozzle tip 7 has a high-pressure water discharge passage 7*a* defining a downstream end of the jet passage 8 and having a diameter reducing as it extends downstream with respect to a high-pressure water jetting direction, and an orifice 7*b* having an elongated (elliptic) shape when seen in the high-pressure water jetting direction, with an inlet thereof communicating with the end of the high-pressure water discharge passage 7*a* downstream with respect to the high-pressure water jetting direction. The orifice 7*b* jets out high-pressure water W against the surface of steel plate, thereby removing scales from the surface of steel plate.

As shown in FIGS. 3–6, the nozzle tip 7 has, formed on an end portion 11 forward with respect to the high-pressure water jetting direction, a flat surface 11*a* extending at right angles to the high-pressure water jetting direction. The flat surface 11*a* has in its center a conical concave section 12 of elliptical shape when seen in the high-pressure water jetting direction, having a diameter reducing as it extends upstream with respect to the high-pressure water jetting direction. The end portion 11 has an annular shape integrally surrounding the entire outer circumference of the concave section 12. The orifice 7*b* has an outlet opening to the entire bottom of the concave section 12. Orifice peripheries 13 are thick-walled in the high-pressure water jetting direction throughout the entire circumference of the orifice 7*b*.

Through the inner circumference of the orifice 7*b* between the inlet and outlet of the orifice 7*b*, is formed an inner surface 14 having a small width (about 0.2 mm in the embodiment) and extending parallel to orifice axis X. The concave section 12 has an opening angle set to about 60°. The high-pressure water W jets out of the orifice 7*b* at a jetting angle of about 27° to be clear of the concave section 12.

Figure 7:
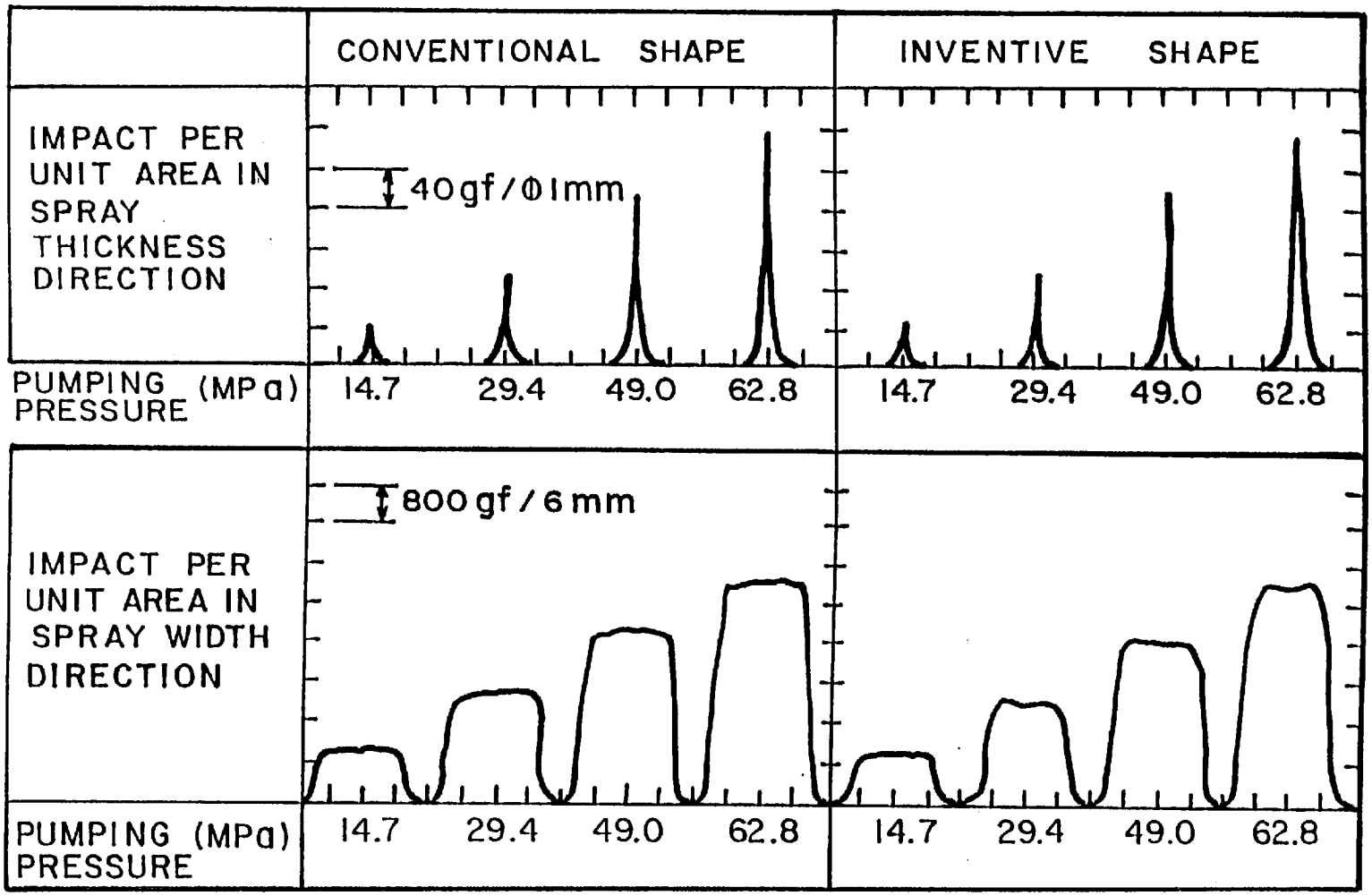
FIG. 7 is a graph for comparing impact distributions.
Figure 8:
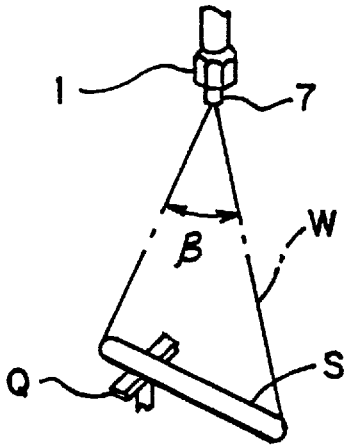
FIG. 8 is a perspective view of a principal portion showing a way of measuring the impact distributions.
Figure 12:
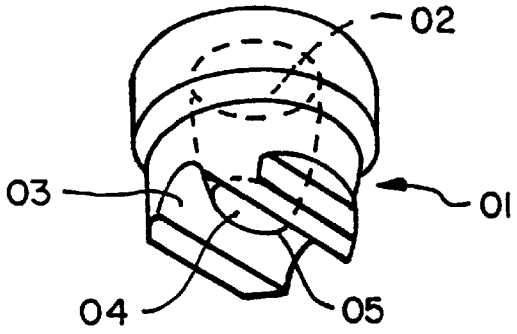
FIG. 12 PRIOR ART
FIG. 12 is a perspective view of a conventional nozzle tip.
Figure 13:
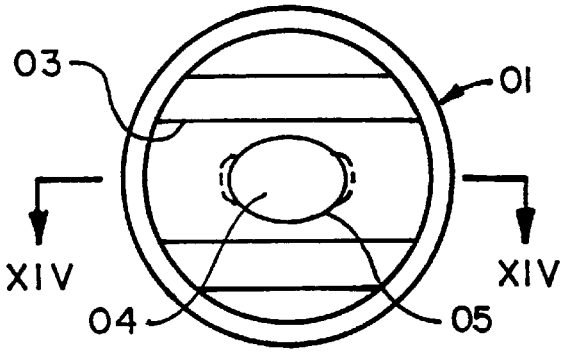
FIG. 13 PRIOR ART
FIG. 13 is a front view of the conventional nozzle tip.
Figure 14:
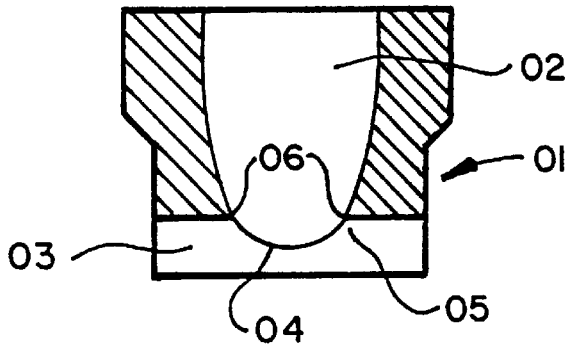
FIG. 14 PRIOR ART
FIG. 14 is a section of taken on line XIV—XIV of FIG. 13.

A descaling nozzle employing the nozzle tip 01 of conventional shape shown in FIG. 12 and a descaling nozzle employing the nozzle tip 7 shaped according to the present invention were manufactured to provide the same flow rate and jetting angle. Then, impact distributions were measured with a pressure sensor Q as shown in FIG. 8, by setting pumping pressure at 14.7 MPa, 29.4 MPa, 49.0 MPa and 62.8 MPa. The results are shown in FIG. 7. It is seen from FIG. 7 that there is little difference between the impact distribution obtained from the nozzle tip 01 having the conventional shape and the impact distribution obtained from the nozzle tip 7 shaped according to the present invention.

Figure 9:
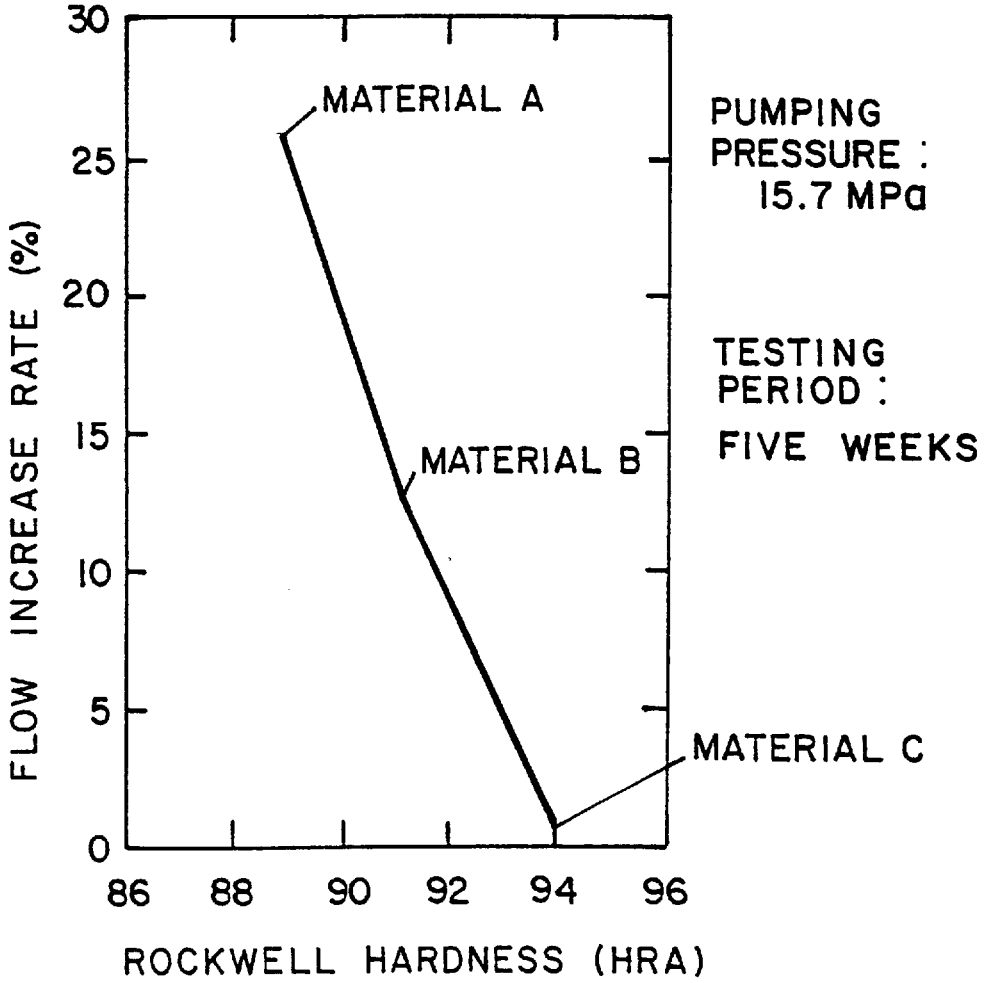
FIG. 9 is a graph showing a relationship between hardness of cemented carbide and flow increase rate.

Nozzle bodies shaped according to the present invention were manufactured by using cemented carbide A, B, and C whose Rockwell hardness (HRA) was 88.7, 90.7, and 94.0, respectively. Each of these nozzle bodies was attached to a descaling nozzle. Each descaling nozzle was used to jet high-pressure water with a pumping pressure of 15.7 MPa for a fixed time period (about five weeks) under the same conditions, and a flow increase rate accompanying damage to the orifice 7*b* was measured. The results shown in percentage in FIG. 9 indicate that the descaling nozzles employing the nozzle bodies formed of cemented carbide A and B had very high flow increase rates. By contrast, the descaling nozzle with the nozzle body formed of cemented carbide C had a minimal increase rate. Varied methods are available for manufacturing cemented carbide having a Rockwell hardness (HRA) of 94.0 or higher. For example, it can easily be obtained by making particles of a carbide intermetallic compound (such as WC) uniform and fine (e.g. 1 (m or less in diameter) or by adding a proper amount of one or more metal carbides (or nitrides), such as titanium, tantalum, and vanadium, to the carbide intermetallic compound.

Second Embodiment

Figure 10:
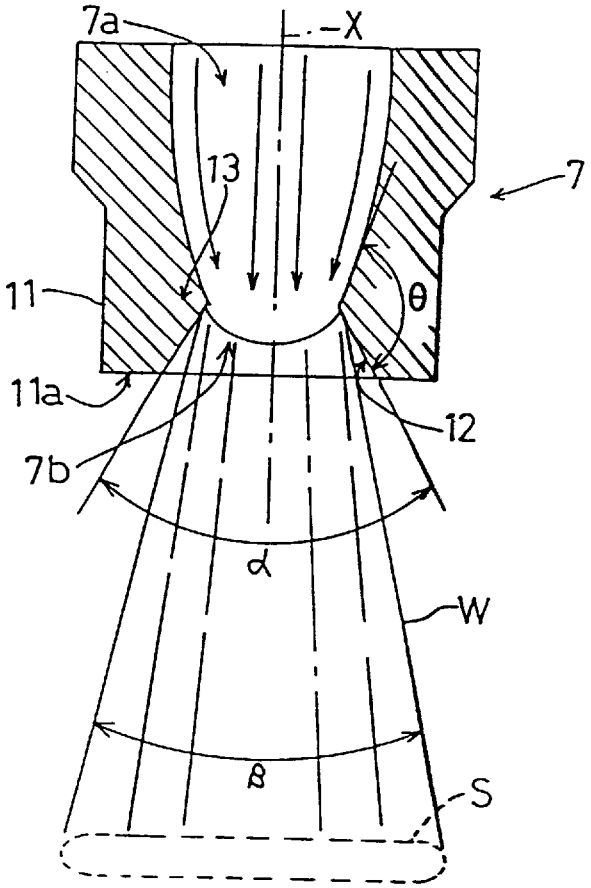
FIG. 10 is a sectional view of a principal portion of a second embodiment.
Figure 11:
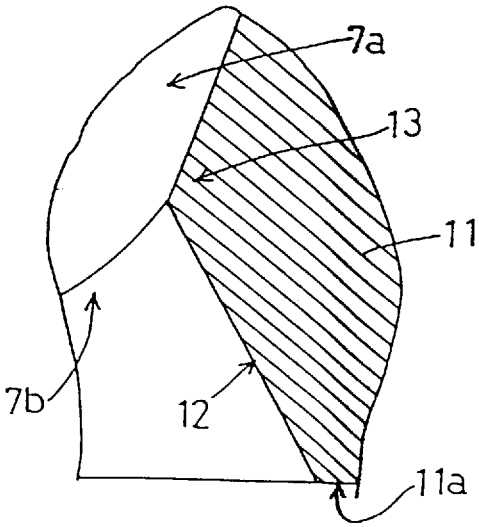
FIG. 11 is a an enlarged view of a portion of FIG. 10.

FIGS. 10 and 11 show an embodiment including no inner surface 14 formed throughout the inner circumference of the orifice 7*b* to be parallel to the orifice axis X as shown in the first embodiment. Other aspects are the same as in the first embodiment. This embodiment can also provide a descaling nozzle having orifice peripheries of higher durability than in the prior art.

Other Embodiments (1) The concave section may be formed to become larger in diameter (like a trumpet).

(2) Inner surfaces parallel to the orifice axis may be formed at parts of the inner circumference of the orifice between the inlet and the outlet thereof.

(3) The concave section may be so formed as to contact the high-pressure liquid jetting from the orifice to control the jetting direction.

Figure 5:
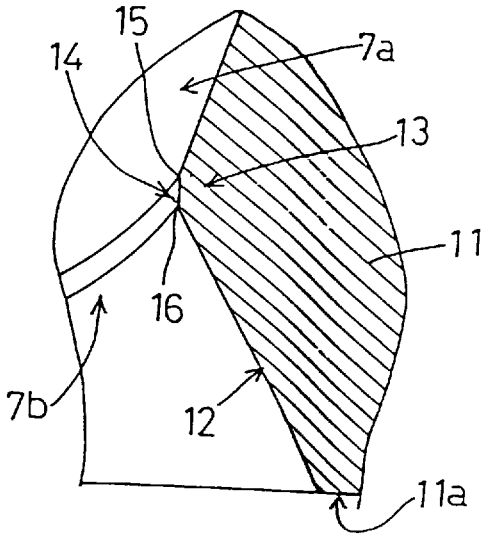
FIG. 5 is an enlarged view of a portion of FIG. 4.
Figure 6:
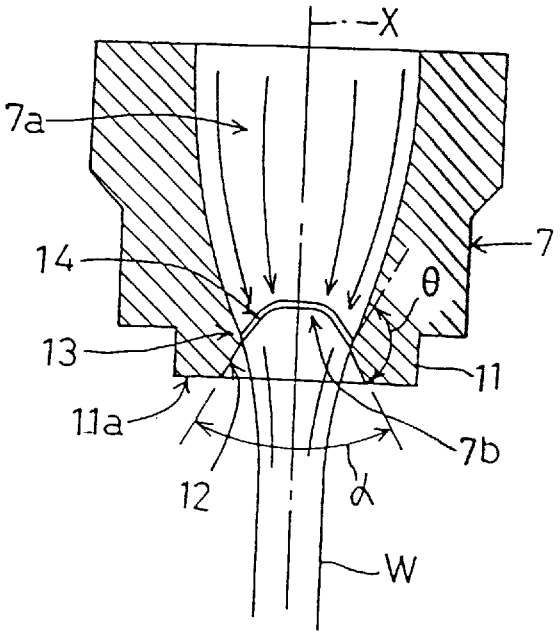
FIG. 6 is a section taken on line VI—VI of FIG. 3.

(4) Instead of forming, through the entire inner circumference of the orifice 7*b*, the inner surface 14 extending parallel to the orifice axis X and between the inlet and the outlet of the orifice 7*b*, this section may be formed with a continuous curve. That is, as shown in FIG. 5, an inlet-side comer 15 and an outlet-side comer 16 of the orifice peripheries 13 are in the form of smooth convex surfaces instead of defining obtuse angles having edges. This construction can also strengthen the orifice peripheries 13, thereby effectively preventing early damage thereof. In this case, it is preferable that the outlet of the orifice peripheries 13 has a small curvature to prevent the concave section from contacting the high-pressure water.

We claim:

1. A descaling nozzle having a nozzle body formed of cemented carbide, comprising:

a liquid passage having a diameter reducing as it extends downstream with respect to a liquid jetting direction;

an orifice having an inlet communicating with an end of said liquid passage downstream with respect to the liquid jetting direction and elongated when seen in the liquid jetting direction said orifice configured to let out a high-pressure liquid against a metal surface to remove scales from the metal surface; and an inner surface formed through an inner circumference of said orifice and extending parallel to an orifice axis and between said inlet and an outlet of said orifice, wherein said nozzle body includes a concave section formed in an end portion and extending in the liquid jetting direction and having a diameter reducing as it extends upstream with respect to the liquid jetting direction, said end portion having an annular-shape integrally surrounding an entire outer circumference of said concave section, and wherein said orifice has an outlet opening at a bottom of said concave section around an entire circumference thereof.

2. A descaling nozzle as claimed in claim 1, wherein said cemented carbide has a Rockwell hardness of 94.0 or higher by A Graduation of Rockwell hardness test stipulated in the Japanese Industrial Standards.

3. A descaling nozzle as claimed in claim 1, wherein said concave section is formed to be out of contact with the high-pressure liquid jetting from said orifice.

4. A descaling nozzle as claimed in claim 2, wherein said carbide includes a carbide hard metal containing carbonized tungsten as a main component.

5. A descaling nozzle as claimed in claim 1, wherein said concave section and said inner surface of said liquid passage form an obtuse angle along a periphery of said orifice through the entire inner circumference of said orifice such that said orifice periphery is thick-walled in the liquid jetting direction through the entire inner circumference of said orifice.

6. A descaling nozzle as claimed in claim 1, wherein said end portion of said nozzle body with respect to the high-pressure water jetting direction has a flat surface extending at right angles to the high-pressure water jetting direction and through an entire circumference of the outlet of said orifice.

7. A descaling nozzle as claimed in claim 1, further comprising a cylindrical passage forming member, a filter screwed to one end of the passage forming member, and a jet passage forming member screwed to the other end of the passage forming member.

8. A descaling nozzle as claimed in claim 7, wherein said passage forming member has a straightening passage with a straightening device mounted therein, and a restricting passage continuous and coaxial with a downstream end of the straightening passage.

9. A descaling nozzle for removing scales from a metal surface, said nozzle having a nozzle body formed of cemented carbide comprising:

a liquid passage having a diameter reducing as it extends downstream with respect to a liquid jetting direction;

an end portion having a flat end surface and defining an orifice, said orifice having an inlet and an outlet, said inlet communicating with an end of said liquid passage downstream with respect to a liquid jetting direction, said orifice elongated when seen in the liquid jetting direction, said flat end surface extending at right angles to the liquid jetting direction and through an entire circumference of said outlet of said orifice;

an inner surface formed through an inner circumference of said orifice and extending parallel to an orifice axis and between said inlet and said outlet of said orifice; and a conical-shaped concave section formed in said end portion and extending in the liquid jetting direction and having a diameter reducing as it extends upstream with respect to the liquid jetting direction, said end portion having an annular-shape integrally surrounding an entire outer circumference of said concave section, said concave section defining said outlet of said orifice at a bottom of said concave section, and wherein said concave section and said inner surface of said liquid passage form an obtuse angle along a periphery of said orifice through said entire inner circumference of said orifice such that said periphery is thick-walled in the liquid jetting direction through said entire inner circumference of said orifice.

10. A descaling nozzle as claimed in claim 9, further comprising a cylindrical passage forming member, a filter screwed to one end of the passage forming member, and a jet passage forming member screwed to the other end of the passage forming member.

11. A descaling nozzle as claimed in claim 9, wherein said cemented carbide has a Rockwell hardness of 94.0 or higher by A Graduation of Rockwell hardness test stipulated in the Japanese Industrial Standards.

12. A descaling nozzle as claimed in claim 9, wherein said conical concave section is formed to be out of contact with the high-pressure liquid jetting from said orifice.

13. A descaling nozzle as claimed in claim 11, wherein said carbide includes a carbide hard metal containing carbonized tungsten as a main component.

14. A descaling nozzle as claimed in claim 13, wherein said passage forming member has a straightening passage with a straightening device mounted therein, and a restricting passage continuous and coaxial with a downstream end of said straightening passage.

* * * * *

UNITED STATES PATENT AND TRADEMARK OFFICE

CERTIFICATE OF CORRECTION

PATENT NO. : 5,878,966

DATED : March 9, 1999

INVENTOR(S) : Hiroyoshi Asakawa and Toshie Hashimoto

It is certified that error appears in the above-identified patent and that said Letters Patent is hereby corrected as shown below:

Column 3 Line 33 "comer 15" should read --corner 15--.

Column 3 Line 33 "comer 16" should read --corner 16--.

Column 5 Line 55 "comer 15" should read --corner 15--

Column 5 Line 55 "comer 16" should read --corner 16--.

Column 6 Line 4 Claim 1 "let" should read --jet--.

Column 8 Line 13 Claim 14 "in claim 13" should read --in claim 10--.

Signed and Sealed this

Twenty-fourth Day of August, 1999

*Attest:*

Q. TODD DICKINSON

*Attesting Officer*

*Acting Commissioner of Patents and Trademarks*